US009027251B2

(12) United States Patent
Schmitt et al.

(10) Patent No.: US 9,027,251 B2
(45) Date of Patent: May 12, 2015

(54) ROTARY ELECTRIC SHAVER

(75) Inventors: Paul Schmitt, Fitchburg, WI (US); William Nitz, Oak Creek, WI (US); Michael Joseph Nickel, Golden, CO (US); Cory R. Boudreau, Madison, WI (US)

(73) Assignee: Spectrum Brands, Inc., Middleton, WI (US)

( * ) Notice: Subject to any disclaimer, the term of this patent is extended or adjusted under 35 U.S.C. 154(b) by 918 days.

(21) Appl. No.: 12/432,602

(22) Filed: Apr. 29, 2009

(65) Prior Publication Data

US 2010/0275446 A1 Nov. 4, 2010

(51) Int. Cl.

| | |
|---|---|
| ***B26B 19/14*** | (2006.01) |
| ***B26B 19/44*** | (2006.01) |
| ***B26B 19/28*** | (2006.01) |
| ***B26B 21/52*** | (2006.01) |

(52) U.S. Cl.

CPC ..... *B26B 19/14* (2013.01); *B26B 19/145* (2013.01); *B26B 19/146* (2013.01)

(58) Field of Classification Search

CPC .... B26B 19/14; B26B 19/145; B26B 19/146; B26B 19/386

USPC ..... 30/41, 41.6, 43.4–45, 346.1, 539, 346, 30/43, 527, 529–532

See application file for complete search history.

(56) References Cited

U.S. PATENT DOCUMENTS

| | | | |
|---|---|---|---|
| 2,359,880 | A | 10/1944 | Scully |
| 2,416,776 | A | 3/1947 | Schlotthauer |
| 2,462,625 | A | 2/1949 | Florman |
| 2,659,139 | A | 11/1953 | Davison |
| 3,242,569 | A | 3/1966 | Van Der Driest |
| 3,656,235 | A | 4/1972 | Zuurveen |
| 3,797,109 | A | 3/1974 | Ikejima et al. |
| D246,731 | S | 12/1977 | Alister |

(Continued)

FOREIGN PATENT DOCUMENTS

| | | | | |
|---|---|---|---|---|
| CN | 201128163 Y | * | 10/2008 | ..... B26B 19/14 |
| CN | 201128163 Y | * | 10/2008 | ..... B26B 19/14 |

(Continued)

OTHER PUBLICATIONS

Superman, Translation of CN201128163Y, Dec. 2007.*

(Continued)

*Primary Examiner* — Kenneth E. Peterson
*Assistant Examiner* — Samuel A Davies
(74) *Attorney, Agent, or Firm* — Armstrong Teasdale LLP

(57) ABSTRACT

A rotary electric shaver generally includes a handle assembly including a housing, a motor disposed in the housing, a plurality of drive shafts operatively connected to the motor and extending at least in part exterior of the housing, and a head assembly mount separate from the plurality of drive shafts, wherein the head assembly mount has a longitudinal axis. A shaver head assembly is positionable on the handle assembly, and the shaver head assembly has a circumference and includes a plurality of inner cutters each operatively connectable to a respective one of the drive shafts for conjoint rotation therewith, and a plurality of outer cutters each corresponding to a respective one of the inner cutters. The shaver head assembly is configured for mounting on the head assembly mount such that the shaver head assembly is capable of pivoting movement relative to the handle housing about the entire circumference of the shaver head assembly.

18 Claims, 12 Drawing Sheets

(56) References Cited

U.S. PATENT DOCUMENTS

D247,857 S 5/1978 Stevens
4,087,909 A 5/1978 Naemura
4,089,110 A 5/1978 Rasco
4,192,065 A 3/1980 Tietjens
4,222,168 A 9/1980 Boiten et al.
4,223,437 A 9/1980 Boiten et al.
4,227,301 A 10/1980 Van Hemmen et al.
D257,744 S 12/1980 van Hemmen et al.
4,258,470 A 3/1981 Boiten et al.
4,259,781 A 4/1981 Boiten et al.
4,262,416 A 4/1981 Van Hemmen et al.
4,272,884 A 6/1981 Tietjens
4,275,497 A 6/1981 Engelhardt et al.
D259,965 S 7/1981 Oord
4,281,453 A 8/1981 Bakker et al.
4,283,849 A 8/1981 Engelhardt et al.
4,318,223 A 3/1982 Bergsma et al.
4,329,781 A 5/1982 Schemmann et al.
4,336,650 A 6/1982 Gorter
D265,431 S 7/1982 Yran
4,343,086 A 8/1982 de Vries et al.
4,347,662 A 9/1982 Tietjens
D270,487 S 9/1983 Nagelkerke et al.
4,475,285 A 10/1984 Hara et al.
4,490,906 A 1/1985 Haes et al.
D279,825 S 7/1985 Takizawa
D282,979 S 3/1986 Nagelkerke et al.
D284,224 S 6/1986 Izumi
4,594,778 A 6/1986 Dona et al.
D285,731 S 9/1986 Satoh et al.
D285,979 S 9/1986 Satoh et al.
D286,089 S 10/1986 Oord
D286,090 S 10/1986 Oord
D288,251 S 2/1987 Izumi
D291,372 S 8/1987 Oord et al.
D291,496 S 8/1987 Oord
D291,497 S 8/1987 Oord
D291,498 S 8/1987 Oord
D291,499 S 8/1987 Oord
4,688,329 A * 8/1987 Oord ..... 30/43.6
4,698,908 A 10/1987 Bergsma et al.
4,707,923 A 11/1987 Tietjens
D293,138 S 12/1987 Oord
D294,981 S 3/1988 Izumi
D294,982 S 3/1988 Izumi
4,729,169 A 3/1988 Asawa
D296,483 S 6/1988 Miyazaki
D297,772 S 9/1988 Izumi
D302,599 S 8/1989 Anema
4,896,421 A 1/1990 Geertsma et al.
D306,360 S 2/1990 Oord et al.
D306,361 S 2/1990 Oord et al.
D306,778 S 3/1990 Meelen
4,910,869 A 3/1990 Labrijn
D307,950 S 5/1990 Sterk
D311,973 S 11/1990 Izumi
D311,974 S 11/1990 Izumi
4,979,297 A 12/1990 Bertram et al.
5,007,168 A 4/1991 Messinger et al.
5,031,315 A 7/1991 Labrijn
D326,735 S 6/1992 Mauro
D326,736 S 6/1992 Oord
D326,737 S 6/1992 Mauro
D326,738 S 6/1992 Mauro
D326,739 S 6/1992 Mauro
D326,930 S 6/1992 Mauro
D331,642 S 12/1992 DiGiovanni
D344,157 S 2/1994 Oord et al.
5,283,953 A 2/1994 Ikuta et al.
D345,823 S 4/1994 Barski
5,301,425 A 4/1994 Ferraro
5,313,704 A 5/1994 Atsumi et al.
D352,569 S 11/1994 Oord
D353,021 S 11/1994 Newman
D353,686 S 12/1994 Izumi
D353,913 S 12/1994 Izumi
D355,276 S 2/1995 Uchiyama et al.
D355,277 S 2/1995 Uchiyama et al.
D355,504 S 2/1995 Uchiyama et al.
D355,505 S 2/1995 Uchiyama et al.
5,390,416 A 2/1995 Uchiyama et al.
5,394,611 A 3/1995 Okabe et al.
5,408,749 A 4/1995 Momose
5,427,001 A 6/1995 Uchiyama et al.
D361,864 S 8/1995 Nakano
5,444,914 A 8/1995 Dekker et al.
D362,320 S 9/1995 Izumi
D363,143 S 10/1995 Ching
D365,174 S 12/1995 Ching
D365,420 S 12/1995 Momose
D367,944 S 3/1996 Izumi
5,577,324 A * 11/1996 Tanaka ..... 30/43.6
5,625,950 A 5/1997 Sterk et al.
D383,247 S 9/1997 Schulz
D383,566 S 9/1997 Bone
5,684,351 A 11/1997 Elferich
5,687,481 A 11/1997 De Boer et al.
5,692,303 A 12/1997 Garenfeld et al.
D389,273 S 1/1998 Bone
D389,275 S 1/1998 Bone
D389,276 S 1/1998 Bone
D405,231 S 2/1999 Nakano
D405,920 S 2/1999 Izumi
D405,921 S 2/1999 Nakano
D405,922 S 2/1999 Bone
D409,797 S 5/1999 Bone
5,909,928 A 6/1999 Barish
D412,599 S 8/1999 De Visser
5,983,501 A 11/1999 Izumi
5,983,502 A 11/1999 Geertsma et al.
6,032,365 A 3/2000 Hodges
D423,719 S 4/2000 De Visser
D424,746 S 5/2000 Lee
D433,188 S 10/2000 Cockerille
D433,533 S 11/2000 Cockerille
6,145,200 A 11/2000 Jorna et al.
D436,228 S 1/2001 Sulik et al.
D437,454 S 2/2001 Cockerille
D437,973 S 2/2001 Cockerille
6,212,776 B1 4/2001 Izumi et al.
D441,911 S 5/2001 van Asten
6,226,870 B1 5/2001 Barish
6,460,252 B1 10/2002 Nakano
D469,219 S 1/2003 McLachlan
6,502,309 B2 1/2003 De Vries et al.
6,553,668 B1 4/2003 Steinberg
6,568,081 B2 5/2003 Barish
6,581,289 B2 6/2003 Nakano
6,647,626 B2 11/2003 Nakano
6,671,960 B2 1/2004 Kawafune et al.
D486,942 S 2/2004 Micinilio et al.
6,688,002 B2 2/2004 Momose et al.
6,722,038 B2 4/2004 Visman et al.
6,763,591 B2 7/2004 Van Der Meer
D495,092 S 8/2004 Massee
6,769,179 B2 8/2004 Satoh et al.
6,823,590 B2 11/2004 Uchiyama et al.
D502,784 S 3/2005 Micinilio et al.
6,868,611 B2 3/2005 Geertsma et al.
D506,037 S 6/2005 Massee
6,901,662 B1 6/2005 Steinberg
6,952,879 B2 10/2005 Okabe
D512,182 S 11/2005 Voege et al.
6,968,620 B2 11/2005 Okabe
D513,342 S 12/2005 Sulik et al.
7,020,965 B2 4/2006 Bao
D520,681 S 5/2006 Beedham
D520,682 S 5/2006 Butcher
7,065,878 B2 6/2006 Uchiyama
D528,701 S 9/2006 Oh
7,152,324 B2 12/2006 Uchiyama
D536,134 S 1/2007 Lee
7,178,242 B2 2/2007 Okabe
D539,475 S 3/2007 Dingelstad

(56) References Cited

U.S. PATENT DOCUMENTS

| | | | | |
|---|---|---|---|---|
| D539,476 | S | 3/2007 | Dingelstad | |
| D539,477 | S | 3/2007 | Dingelstad | |
| D542,473 | S | 5/2007 | McLachlan | |
| D542,973 | S | 5/2007 | Prat-Pfister et al. | |
| 7,222,428 | B2 | 5/2007 | Koike | |
| D544,999 | S | 6/2007 | Prat-Pfister | |
| D546,001 | S | 7/2007 | McLachlan | |
| D549,391 | S | 8/2007 | Kawafune | |
| D549,873 | S | 8/2007 | Prat-Pfister | |
| D550,901 | S | 9/2007 | Massee | |
| 7,269,902 | B2 | 9/2007 | Van Der Meer | |
| D563,599 | S | 3/2008 | Prat-Pfister | |
| 7,356,929 | B2 | 4/2008 | Nakano | |
| 7,370,420 | B2 | 5/2008 | Shimizu | |
| 7,401,407 | B2 | 7/2008 | Miyasaka | |
| 7,472,483 | B2 | 1/2009 | Beugels | |
| D586,044 | S | 2/2009 | Wilson et al. | |
| 7,487,592 | B2 | 2/2009 | Koike | |
| D587,848 | S | 3/2009 | Leventhal et al. | |
| 7,509,741 | B2 | 3/2009 | Shimizu | |
| 7,530,171 | B2 | 5/2009 | Baron et al. | |
| 7,584,541 | B2 | 9/2009 | Uchiyama | |
| 7,603,777 | B2 | 10/2009 | Shumizu | |
| 7,743,508 | B2 | 6/2010 | Shimizu | |
| 8,220,157 | B2 | 7/2012 | Shimizu | |
| 8,230,601 | B2 | 7/2012 | Shimizu | |
| 8,296,954 | B2 | 10/2012 | Schneider et al. | |
| 2001/0039734 | A1 | 11/2001 | Kadijk et al. | |
| 2002/0062565 | A1* | 5/2002 | Uchiyama et al. | 30/43.6 |
| 2003/0070304 | A1 | 4/2003 | Curello | |
| 2003/0177642 | A1 | 9/2003 | Bax | |
| 2004/0078985 | A1 | 4/2004 | Chen | |
| 2004/0194316 | A1 | 10/2004 | Lin et al. | |
| 2004/0205969 | A1 | 10/2004 | Haites et al. | |
| 2004/0237309 | A1 | 12/2004 | Kawafune | |
| 2005/0183267 | A1 | 8/2005 | Okabe | |
| 2005/0229400 | A1* | 10/2005 | Yamaguchi et al. | 30/43.92 |
| 2005/0236070 | A1 | 10/2005 | Blaauw et al. | |
| 2005/0257376 | A1 | 11/2005 | De Wit et al. | |
| 2006/0042100 | A1 | 3/2006 | Everett, Jr. | |
| 2006/0048390 | A1 | 3/2006 | Baron et al. | |
| 2006/0150420 | A1 | 7/2006 | Sinnema et al. | |
| 2006/0156550 | A1 | 7/2006 | Beugels et al. | |
| 2006/0179657 | A1 | 8/2006 | Van Der Linden et al. | |
| 2006/0179658 | A1 | 8/2006 | Nakano | |
| 2006/0179659 | A1 | 8/2006 | Nakano | |
| 2006/0260130 | A1* | 11/2006 | Shimizu | 30/43.6 |
| 2007/0079510 | A1 | 4/2007 | Hannan et al. | |
| 2007/0084059 | A1 | 4/2007 | Hannan et al. | |
| 2007/0089298 | A1 | 4/2007 | Shimizu | |
| 2007/0101575 | A1 | 5/2007 | Uchiyama | |
| 2007/0107230 | A1* | 5/2007 | Baron et al. | 30/43.6 |
| 2007/0113408 | A1 | 5/2007 | Okabe | |
| 2007/0124936 | A1 | 6/2007 | Okabe | |
| 2007/0234572 | A1 | 10/2007 | Hannan et al. | |
| 2007/0256302 | A1 | 11/2007 | Okabe | |
| 2007/0277379 | A1 | 12/2007 | Okabe | |
| 2008/0028618 | A1 | 2/2008 | Okabe | |
| 2008/0034591 | A1 | 2/2008 | Fung | |
| 2008/0072429 | A1 | 3/2008 | Uchiyama | |
| 2008/0092392 | A1 | 4/2008 | Shimizu | |
| 2008/0092393 | A1* | 4/2008 | Van Der Meer | 30/43.6 |
| 2008/0134513 | A1 | 6/2008 | Oh | |
| 2008/0172881 | A1 | 7/2008 | Okabe | |
| 2008/0189952 | A1 | 8/2008 | Everett et al. | |
| 2008/0276459 | A1 | 11/2008 | De Wit et al. | |
| 2008/0294176 | A1 | 11/2008 | Hashiguchi et al. | |
| 2008/0313910 | A1 | 12/2008 | Walls | |
| 2009/0019703 | A1 | 1/2009 | Minkes et al. | |
| 2009/0025227 | A1 | 1/2009 | Minkes et al. | |
| 2009/0025228 | A1 | 1/2009 | Minkes et al. | |
| 2009/0049694 | A1 | 2/2009 | Morris | |
| 2009/0320294 | A1 | 12/2009 | Shimizu | |
| 2009/0320295 | A1 | 12/2009 | Shimizu | |
| 2010/0011589 | A1 | 1/2010 | Van Der Borst et al. | |
| 2010/0275446 | A1 | 11/2010 | Schmitt et al. | |
| 2011/0030220 | A1 | 2/2011 | Shimizu | |
| 2011/0167641 | A1 | 7/2011 | Brada et al. | |
| 2011/0173815 | A1 | 7/2011 | Koike | |
| 2011/0308088 | A1 | 12/2011 | Brada et al. | |

FOREIGN PATENT DOCUMENTS

| | | | | |
|---|---|---|---|---|
| CN | 201198144 | * | 2/2009 | B26B 19/14 |
| CN | 201198144 | Y | 2/2009 | |
| EP | 0176128 | A1 | 4/1986 | |
| EP | 543460 | B1 | 5/1996 | |
| EP | 0721826 | A2 | 7/1996 | |
| EP | 0757613 | B1 | 12/2001 | |
| EP | 0860247 | B1 | 9/2002 | |
| EP | 1509367 | A1 | 3/2005 | |
| EP | 1854592 | A1 | 11/2007 | |
| EP | 1862271 | A1 | 12/2007 | |
| EP | 2281670 | A1 | 2/2011 | |
| EP | 2004364 | B1 | 4/2011 | |
| EP | 2463067 | A1 | 6/2012 | |
| EP | 2614937 | A1 | 7/2013 | |
| GB | 2448699 | A | 4/2007 | |
| JP | 5146564 | A | 6/1993 | |
| SU | 751625 | A1 | 7/1980 | |
| WO | 9626046 | A1 | 8/1996 | |
| WO | 03059584 | A1 | 7/2003 | |
| WO | 2006056950 | A1 | 6/2006 | |
| WO | 2006067710 | A1 | 6/2006 | |
| WO | 2006067713 | A1 | 6/2006 | |
| WO | 2006067721 | A1 | 6/2006 | |
| WO | 2006134541 | A1 | 12/2006 | |
| WO | 2007007307 | A2 | 1/2007 | |
| WO | 2008010139 | A1 | 1/2008 | |
| WO | 2008062339 | A1 | 5/2008 | |
| WO | 2009129667 | A1 | 10/2009 | |
| WO | 2010034175 | A1 | 4/2010 | |
| WO | 2010103425 | A1 | 9/2010 | |

OTHER PUBLICATIONS

Partial European Search Report, Application No. 1025085.3-2313 for Rovcal, Inc. dated Jul. 22, 2010, 5 pages.

Extended European Search Report, Application No. 1025085.3-2313 for Rovcal, Inc. dated Nov. 9, 2010, 9 pages.

Extended European Search Report dated Apr. 26, 2012 re Application No. 12158502.0-2313, 6 pages.

EPO Office Action dated Jan. 31, 2013; Application No. 12 158 502.0-2313, 4 pages.

* cited by examiner

ROTARY ELECTRIC SHAVER

BACKGROUND

The present invention relates generally to electric shavers and, more particularly, to rotary electric shavers.

Rotary electric shavers conventionally include a handle and a head mounted on the handle and carrying two or more sets of paired inner and outer cutter blades. The outer cutter blades, which are typically circular in shape, are supported by a frame of the shaver head and typically define the skin contacting surface of the shaver along with the outer surface of the shaver head. Openings or slots formed in the outer cutter allow hair to protrude through the outer cutter below an inner surface thereof as the shaver is moved over a user's skin. Inner cutter blades are housed in the shaver head below the outer cutter in sliding engagement with the inner surface of the outer cutter. The inner cutter blades are rotatably driven by an electric motor, typically housed within the handle, whereby rotation of the inner cutter acts to cut hairs protruding through the outer cutter.

In current rotary electric shaver constructions, the frame and the outer cutters together define the outer skin-facing or skin-contacting surface of the shaver, with the outer cutters each extending individually outward of the frame. However, when shaving with a rotary shaver, the outer cutters must pass over the user's various skin contours. The transition of the outer cutter over the skin surface is thus often not smooth and can be abrupt. The smoother the transition is over the entire skin-facing outer surface of the shaver head (e.g., from the frame to the outer surface of the outer cutter), the more comfortable the shaving experience will be.

With this current construction, as the shaver is moved over the user's face the skin is forced up over the edges of the outer cutters. This action causes the skin to drag, or become pinched, and the shaver does not glide smoothly onto the top surface of the outer cutter.

There is a need, therefore, for a rotary electric shaver that facilitates a smoother, more comfortable shave.

SUMMARY OF THE INVENTION

In one embodiment, an electric rotary shaver generally includes a handle assembly including a housing, a motor disposed in the housing, a plurality of drive shafts operatively connected to the motor and extending at least in part exterior of the housing, and a head assembly mount separate from the plurality of drive shafts, wherein the head assembly mount has a longitudinal axis. A shaver head assembly is positionable on the handle assembly, and the shaver head assembly has a circumference and includes a plurality of inner cutters each operatively connectable to a respective one of the drive shafts for conjoint rotation therewith, and a plurality of outer cutters each corresponding to a respective one of the inner cutters. The shaver head assembly is configured for mounting on the head assembly mount such that the shaver head assembly is capable of pivoting movement relative to the handle housing about the entire circumference of the shaver head assembly.

In another embodiment, a shaver head assembly for an electric rotary shaver is provided. The electric rotary shaver has a handle including a housing, a motor, and a plurality of drive shafts accessible by the shaver head assembly exterior of the housing. The shaver head assembly is positionable on the handle assembly and generally includes a plurality of inner cutters each operatively connectable to a respective one of the drive shafts of the shaver for conjoint rotation therewith. A plurality of outer cutters each corresponds to a respective one of the inner cutters, and a plurality of cutter cases each corresponds to a respective one of the outer cutters and is configured to support the respective one of the outer cutters on the shaver head assembly. Each cutter case is releasably mountable on the shaver head assembly independent of other cutter cases and is removeable from the shaver head assembly while the shaver head assembly is positioned on the shaver handle assembly.

In yet another embodiment, a shaver head assembly for an electric rotary shaver is provided. The electric rotary shaver has a handle assembly including a housing, a motor, and a plurality of drive shafts accessible by the shaver head assembly exterior of the housing. The shaver head assembly is positionable on the handle assembly and generally includes a plurality of inner cutters each operatively connectable to a respective one of the drive shafts of the shaver for conjoint rotation therewith. The plurality of outer cutters each corresponds to a respective one of the inner cutters, and a plurality of cutter cases each corresponds to a respective one of the outer cutters and is configured to support the respective one of the outer cutters on the shaver head assembly. Each cutter case includes an annular body having an upper skin contacting surface and a peripheral skin contacting surface circumscribing and depending from the upper skin contacting surface to define an angle of the peripheral skin contacting surface relative to the upper skin contacting surface. The upper skin contacting surface has a width, and at least one of the width of the upper skin contacting surface and the angle of the peripheral contacting surface relative to the upper skin contacting surface is non-uniform about at least a portion of the cutter case.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
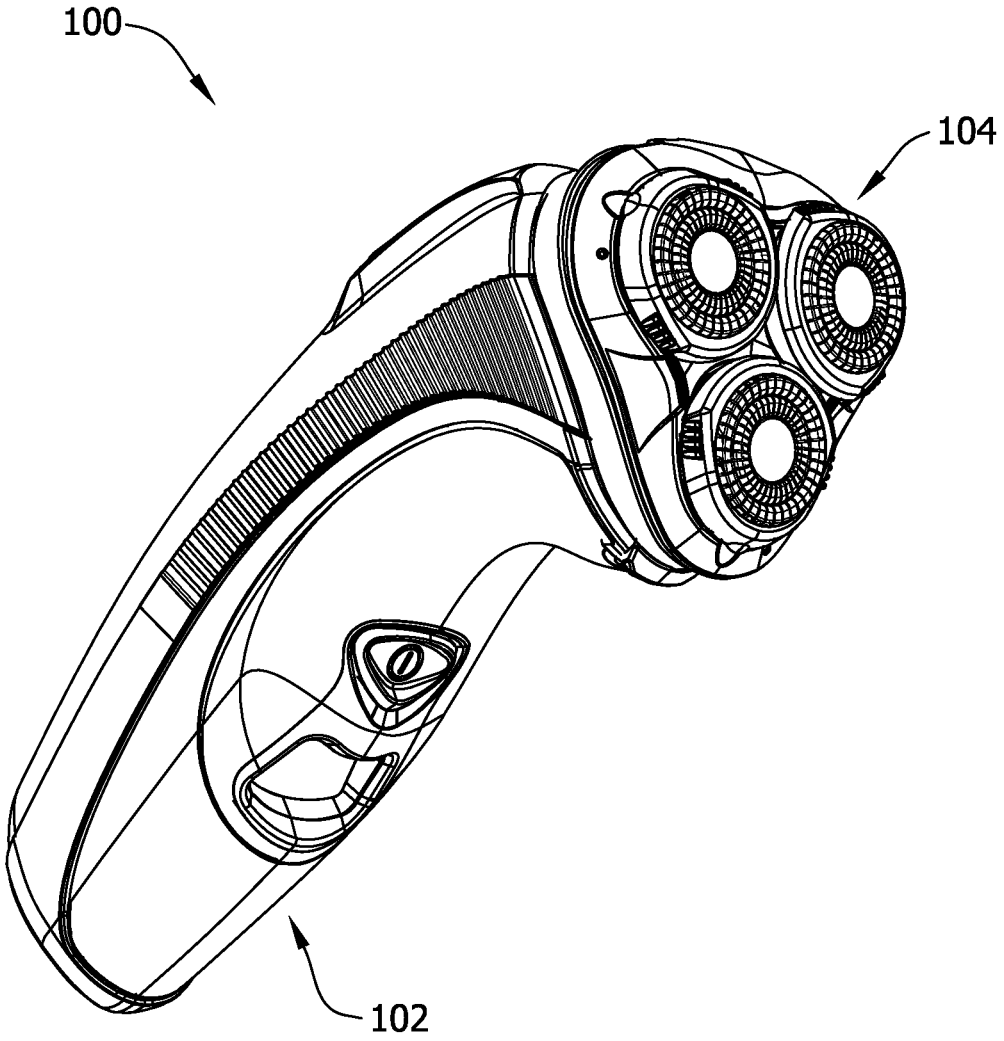
FIG. 1 is a perspective view of one embodiment of a rotary shaver.
Figure 2:
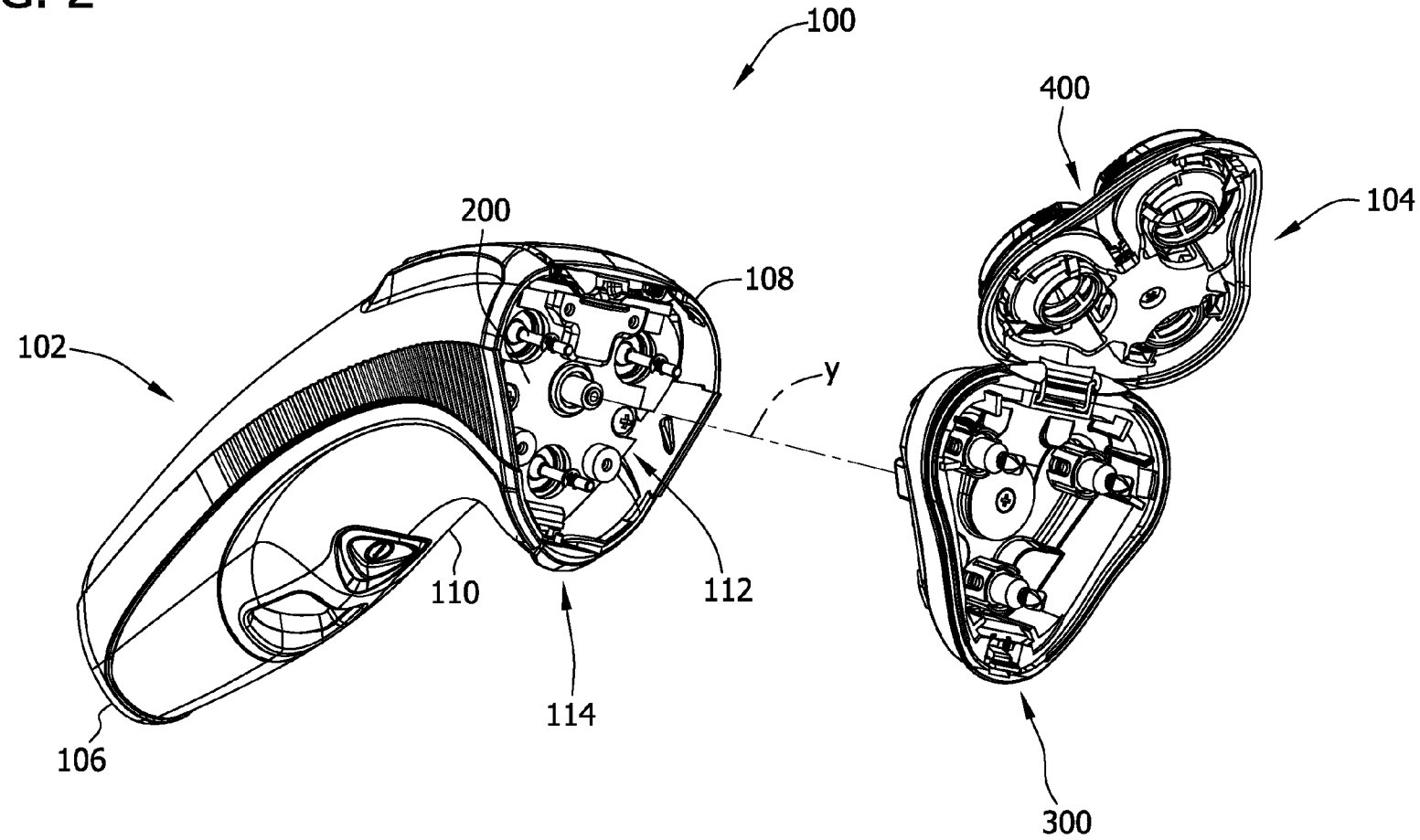
FIG. 2 is an exploded view of the rotary shaver of FIG. 1 with a portion of a shaver head assembly illustrated in an open configuration.

Referring now to the drawings, and in particular to FIGS. 1 and 2, a rotary shaver according to one embodiment is indicated in its entirety by the reference numeral 100. In the illustrated embodiment, the shaver 100 comprises a handle assembly 102 and a head assembly 104 mounted on the handle assembly 102. The handle assembly 102 has a first or distal end 106, a second or proximal end 108, a lock release button 114 proximate the second end 108, and a hollow housing 110 extending from the first end 106 to the second end 108, such that a battery, a motor, and gearing may be housed within the handle assembly 102. Suitably, the handle assembly 102 has a substantially triangular upper receptacle 112 formed by a head assembly mount 200 that is recessed relative to the second end 108. It is also contemplated, however, that the handle assembly 102 may house any suitable operational components of the shaver 100 and/or that the receptacle 112 may have any suitable cross-section without departing from the scope of this invention.

Figure 3:
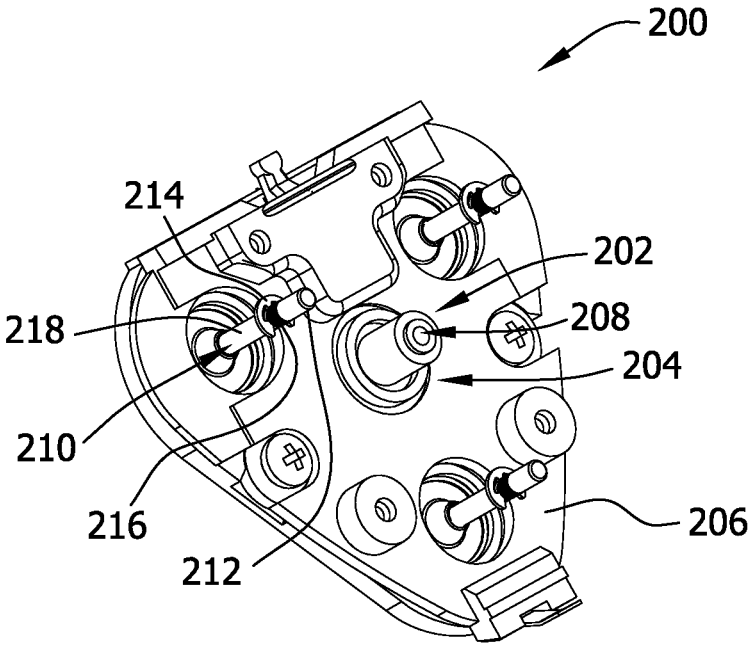
FIG. 3 is a perspective view of a head assembly mount of the rotary shaver of FIG. 1.

FIG. 3 is an enlarged perspective view of the head assembly mount 200. In the illustrated embodiment, the head assembly mount 200 comprises a spring seat 202 that extends into the upper receptacle 112 from a central region 204 of an upper surface 206 of the head assembly mount 200 and defines a threaded bore 208. Three substantially similar drive shafts 210 protrude into the upper receptacle 112 through the head assembly mount 200 in a generally triangular configuration about the spring seat 202. Additionally, each drive shaft 210 is operatively connected to the motor via the internal gearing within the handle assembly 102, and each drive shaft 210 comprises a tip 212, a retaining ring 214 connected to the drive shaft 210, and a roughened surface 216 formed on an outer surface 218 between the tip 212 and the retaining ring 214. In one embodiment, the retaining ring 214 is connected to the shaft 210 via a snap-fit (e.g., a snap-fit within a groove of the shaft 210). Alternatively, the retaining ring 214 and/or the roughened surface 216 may be connected to the shaft 210 via any suitable fastener. It is also contemplated that the head assembly mount 200 may have any suitable shape and/or may have any suitable drive mechanisms protruding therethrough in any suitable configuration without departing from the scope of this invention.

In the illustrated embodiment, referring again to FIG. 2, the head assembly 104 comprises a hair retention assembly 300 having a circumference sized such that the hair retention assembly 300 is insertable into the upper receptacle 112, and a cutter frame assembly 400 connected (e.g., hinged) to the hair retention assembly 300 and sized such that the cutter frame assembly 400 substantially covers the hair retention assembly 300, as described below.

Figure 4:
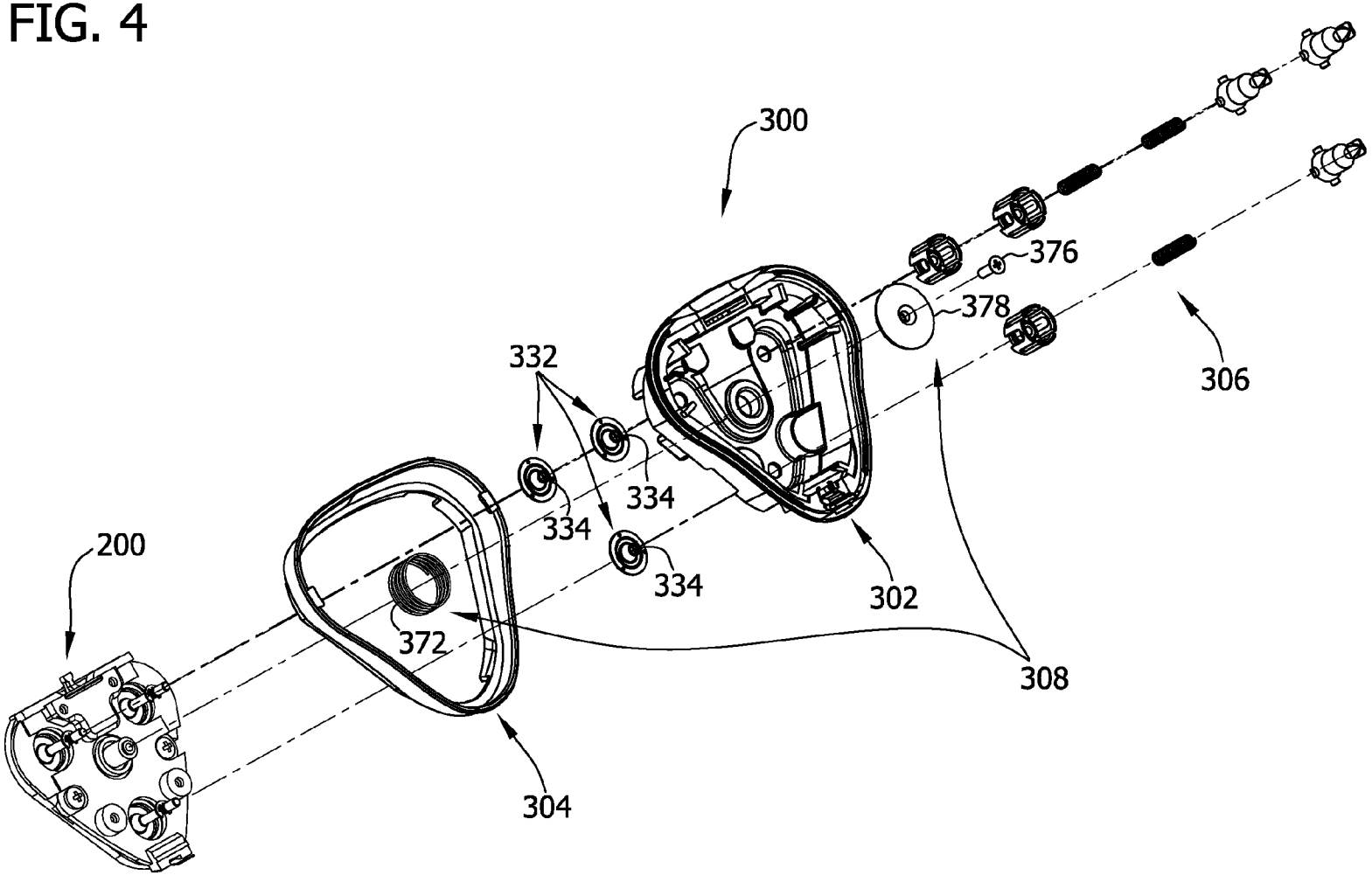
FIG. 4 is an exploded view of a hair retention assembly of the rotary shaver of FIG. 1.
Figure 5:
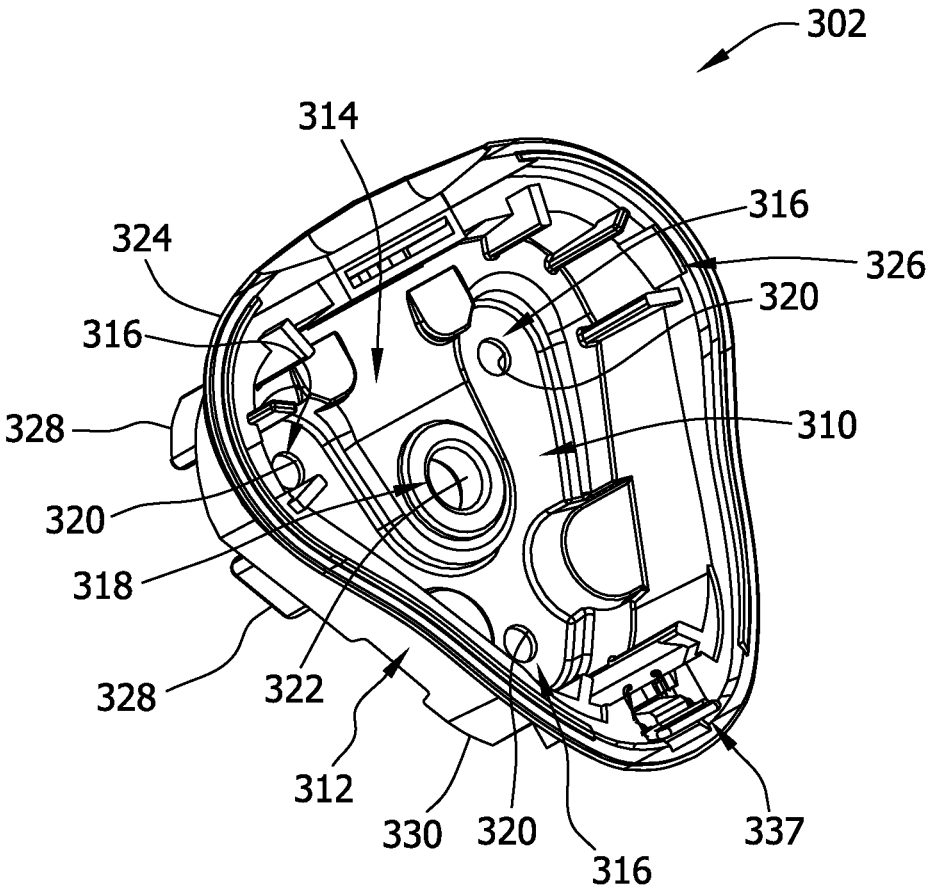
FIG. 5 is a perspective view of a tray of the hair retention assembly of FIG. 4.

FIG. 4 is an exploded view of the hair retention assembly 300 positioned atop the head assembly mount 200. The illustrated hair retention assembly 300 comprises a tray 302, a boot 304, a plurality of torque transfer assemblies 306, and a pivot assembly 308. FIG. 5 is an enlarged perspective view of the tray 302. The illustrated tray 302 comprises a base 310 and a peripheral sidewall 312 projecting from the base 310 such that the base 310 and sidewall 312 together form a hair pocket 314 for collecting hair clippings. The base 310 has a plurality of shaft apertures 316 and a central bore 318, wherein the shaft apertures 316 are substantially equidistantly spaced about the central bore 318 in a generally triangular configuration that corresponds to the arrangement of the drive shafts 210. Each shaft aperture 316 is suitably sized to receive one of the drive shafts 210 therethrough, and the central bore 318 is sized to receive the spring seat 202 therethrough. Suitably, the peripheral sidewall 312 of the tray 302 comprises an annular rim 324 extending transversely outward, and a plurality of tab slots 326 arranged below the rim 324 to facilitate supporting the boot 304, as described below. Optionally, a lock 337 may be positioned proximate the rim 324 to facilitating locking the head assembly 104 to seal the hair pocket 314 (i.e., locking the cutter frame assembly 400 and the hair retention assembly 300 in a closed position), as described below.

The illustrated base 310 further comprises a plurality of feet 328 projecting from a bottom surface 330 of the base 310 to facilitate maintaining a predetermined minimum spacing between the base 310 and the head assembly mount 200 of the handle assembly 102 when the hair retention assembly 300 is inserted into the upper receptacle 112. Suitably, a plurality of seals 332 (shown in FIG. 4) may be connected to the bottom surface 330 of the base 310 about the shaft apertures 316 (i.e., via any suitable adhesive and/or mechanical fastener). Each seal 332 comprises a hole 334 (shown in FIG. 4) that is sized to receive one of the shafts 210 such that the seal 332 facilitates preventing hair and/or other debris within the hair pocket 314 from entering the upper receptacle 112 of the handle assembly 102 via the corresponding shaft aperture 316.

Figure 6:
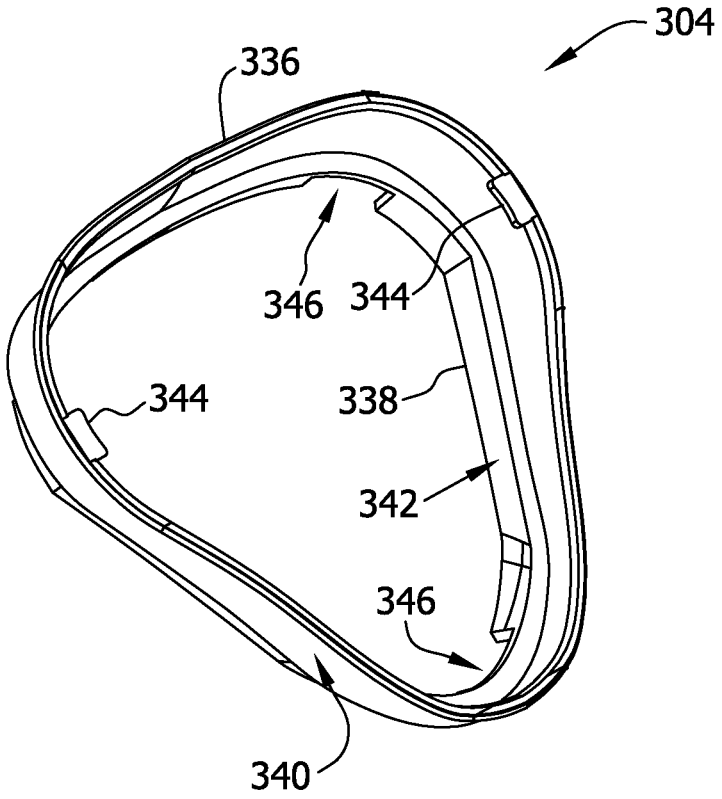
FIG. 6 is a perspective view of a boot of the hair retention assembly of FIG. 4.

With particular reference to FIG. 6, the illustrated boot 304 is generally triangular and is suitably fabricated from a synthetic or semi-synthetic, organic-based material (e.g., a "rubber" material) such that the boot 304 is stretchable to receive the tray 302 (i.e., to facilitate conforming the boot 304 to a curvature of the tray 302). The boot 304 comprises a top edge 336, a bottom edge 338, a gripping portion 340, and a skirt portion 342. In one embodiment, the gripping portion 340 is formed integrally with the skirt portion 342. In other embodiments, the gripping portion 340 may be formed separate from and connected to the skirt portion 342 using any suitable fastening technique. The illustrated gripping portion 340 comprises a plurality of inwardly extending tabs 344, wherein each tab 344 is sized for insertion into one of the tab slots 326 of the tray 302 to facilitate securement of the boot 304 on the tray 302. In one embodiment, the skirt portion 342 depends from the gripping portion 340 and is sized to loosely grip the tray 302 and to define a plurality of notches 346 that accommodate portions of the handle assembly 102 (e.g., the lock release button 114) when the tray 302 is inserted into the boot 304 and the upper receptacle 112.

Figure 7:
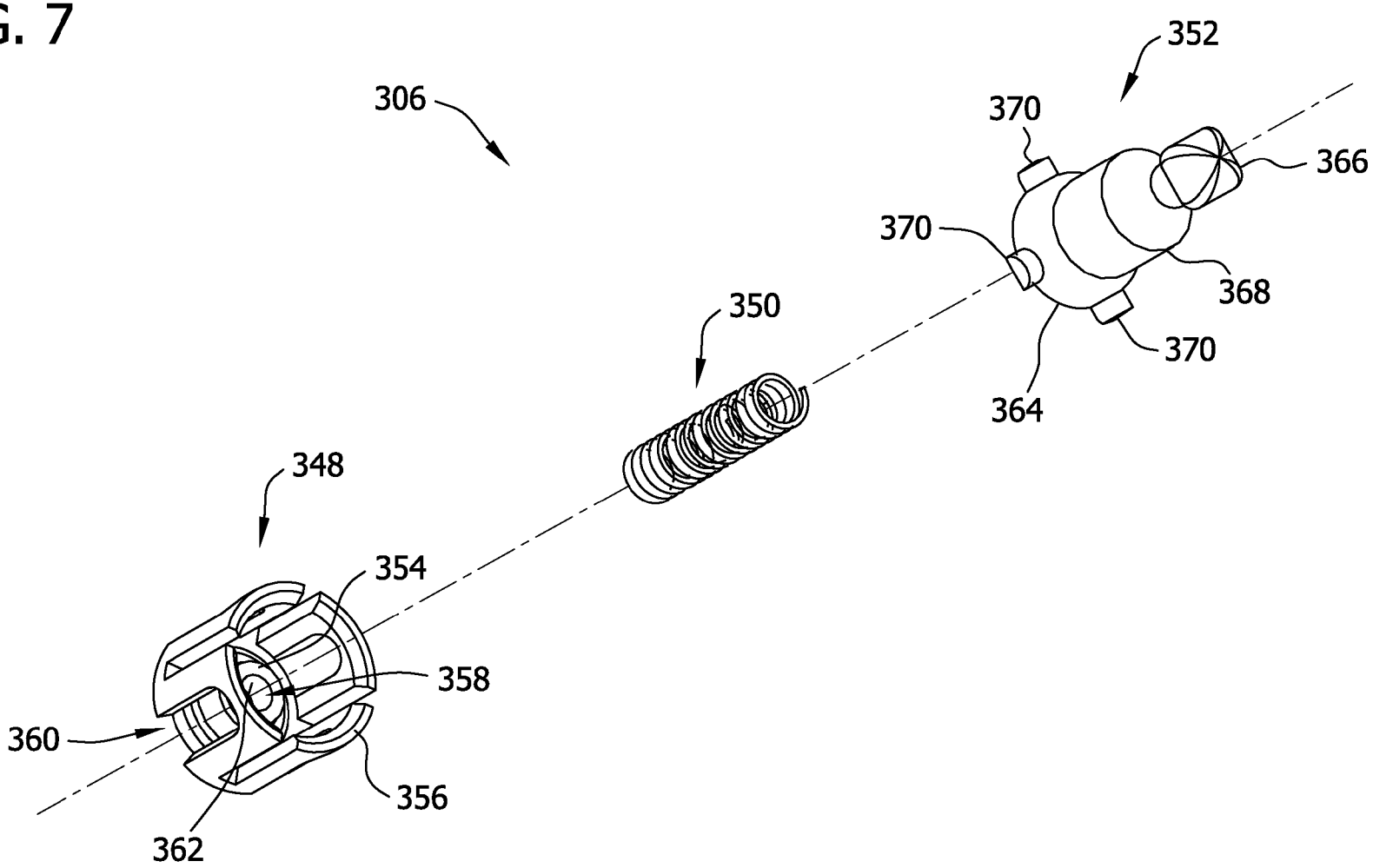
FIG. 7 is an exploded view of a torque transfer assembly of the hair retention assembly of FIG. 4.

FIG. 7 illustrates an enlarged perspective view of the torque transfer assembly 306, which generally comprises a cap 348, a biasing member 350 (e.g., in the illustrated embodiment a coil spring) sized to be inserted into the cap 348, and a pin 352 sized to seat atop the biasing member 350. The cap 348 comprises a bottom wall 354 having a port 358, and a generally cylindrical sidewall 356 extending upward from the bottom wall 354 and having a plurality of longitudinally extending channels 360 formed therein. Suitably, the port 358 is sized to receive the tip 212 of the drive shaft 210 therethrough such that the roughened surface 216 of the drive shaft 210 engages an inner surface 362 of the port 358 and such that the bottom wall 354 of the cap 348 is seated on the retaining ring 214 of the drive shaft 210 to facilitate supporting the torque transfer assembly 306 on the drive shaft 210 and transferring torque from the drive shaft 210 to the cutter frame assembly 400 during a shaving operation.

The illustrated pin 352 comprises a generally hollow body 368, an open base 364 at one end, and a tip 366 at the opposite end. The base 364 has a plurality of guides 370 extending transversely outward therefrom, wherein each guide 370 is sized to slide within one of the channels 360 of the cap 348 such that the pin 352 is floatable upward and downward in the cap 348. Suitably, the body 368 is externally sized (e.g., in transverse cross-section) such that a space is left between the body 368 and the sidewall 356 of the cap 348 when the pin 352 is inserted into the cap 348 to facilitate pivoting movement of the pin 352 within the cap 348. The body 368 is also sized internally (e.g., in transverse cross-section) to receive the biasing member 350 such that the pin 352 is biased away from the bottom wall 354 of the cap 348. Additionally, the tip 366 of the pin 352 is generally cross-shaped to facilitate transferring torque from the cap 348 to the cutter frame assembly 400 during a shaving operation, as described below.

Referring again to FIG. 4, the illustrated pivot assembly 308 comprises a resilient biasing element (e.g., a spring 372), a fastener (e.g., a screw 376), and a washer 378. The illustrated spring 372 is sized to be seated on the upper surface 206 of the head assembly mount 200 about the spring seat 202, and the screw 376 is sized for insertion through the washer 378, through the central bore 318 of the tray 302, through the spring 372, and into the threaded bore 208 of the spring seat 202 to facilitate pivotably mounting the tray 302 on the head assembly mount 200 with the spring 372 positioned between the tray 302 and the head assembly mount 200. Suitably, the washer 378 substantially covers the central bore 318 of the tray 302 to inhibit hair from entering the upper receptacle 112 from the hair pocket 314 via the central bore 318.

Figure 8:
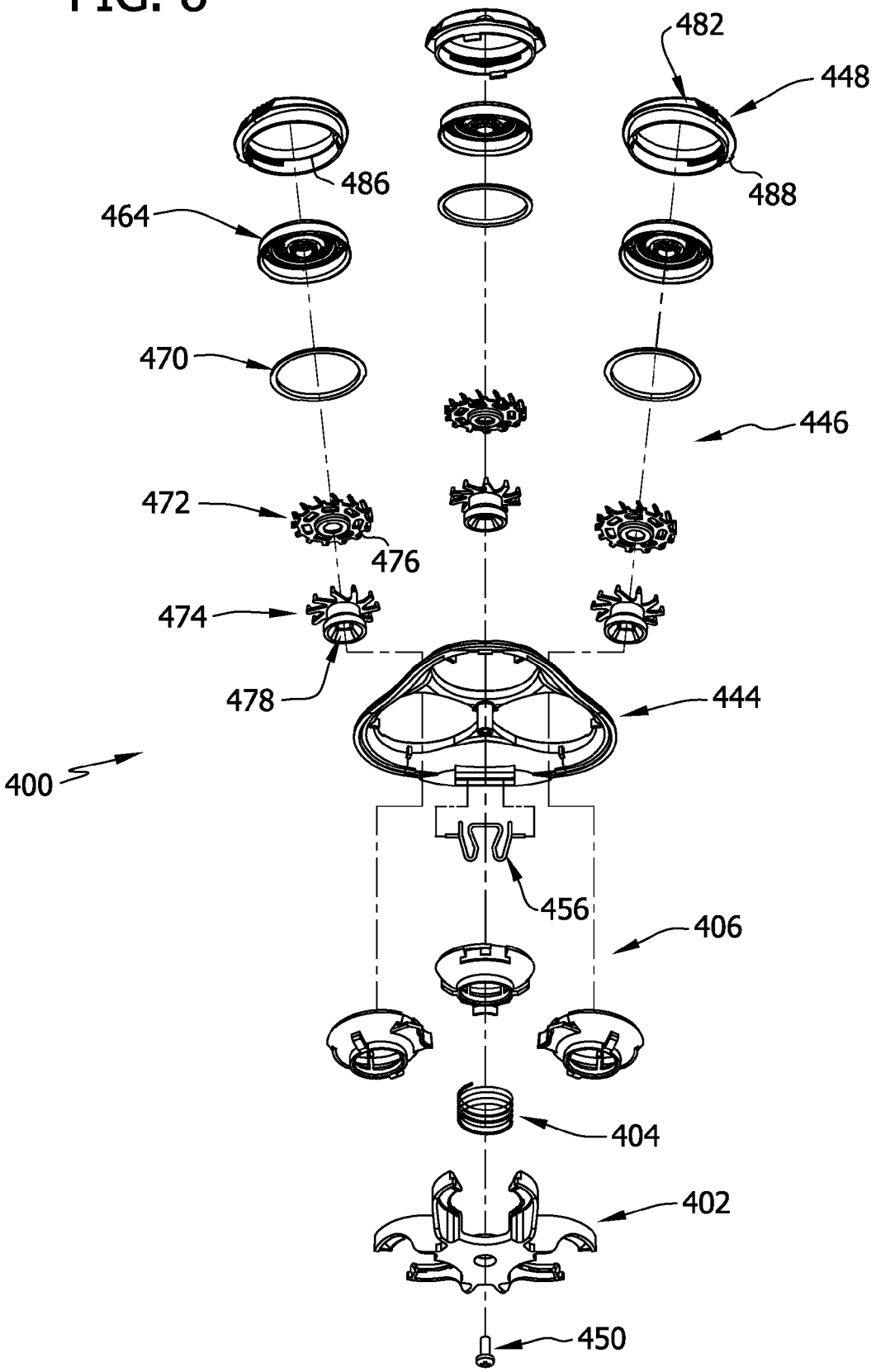
FIG. 8 is an exploded view of a cutter frame assembly of the rotary shaver of FIG. 1.
Figure 9:
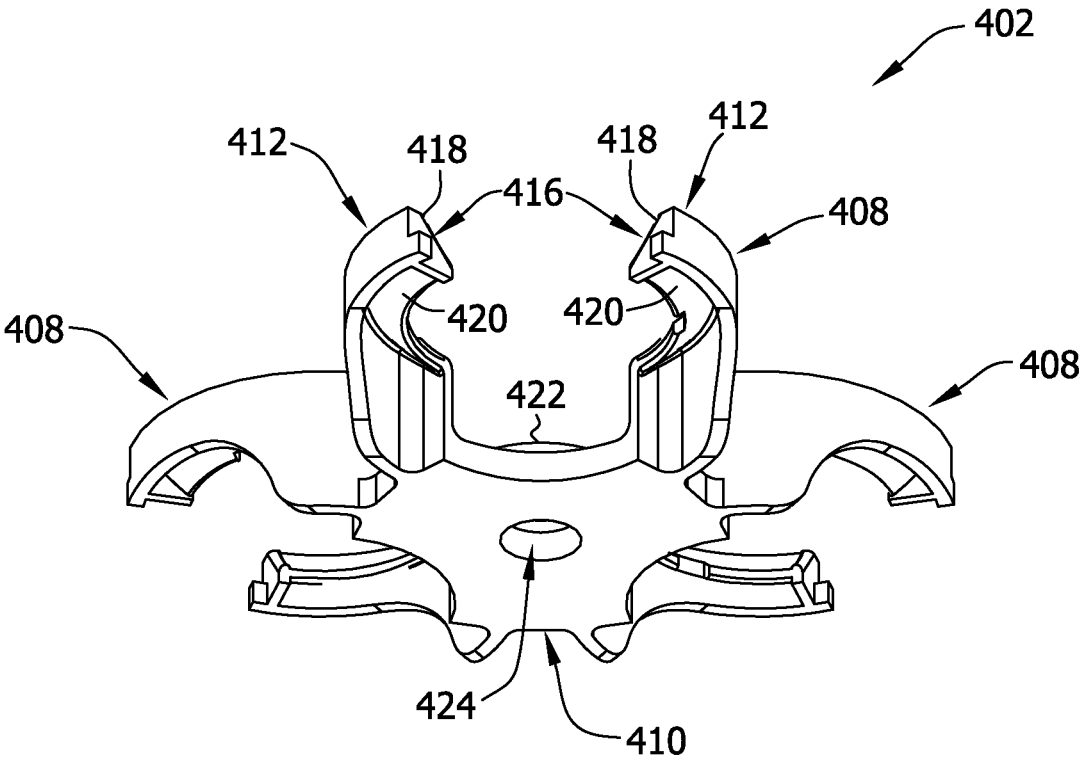
FIG. 9 is a perspective view of a lower cutter frame of the cutter frame assembly of FIG. 8.

FIG. 8 is an exploded view of the cutter frame assembly 400. In the illustrated embodiment, the cutter frame assembly 400 comprises a lower cutter frame 402, a biasing element 404, and three cutter holders 406. The illustrated lower cutter frame 402 comprises (with reference to FIG. 9) three holder supports 408, each having a generally open-ring shape so as to define a pair of opposed, arcuately-shaped arms 412 extending outward from the base 410 and spaced from each other to further define an opening of the support 408. Each arm 412 further comprises a sloped inner wall 416 that has an upper surface 418 and a lower surface 420. The base 410 comprises an upwardly projecting spring seat 422 and a bore 424 extending through the base 410 and the spring seat 422. Suitably, the biasing element 404 is sized to be seated on the base 410 about the spring seat 422.

Figure 10:
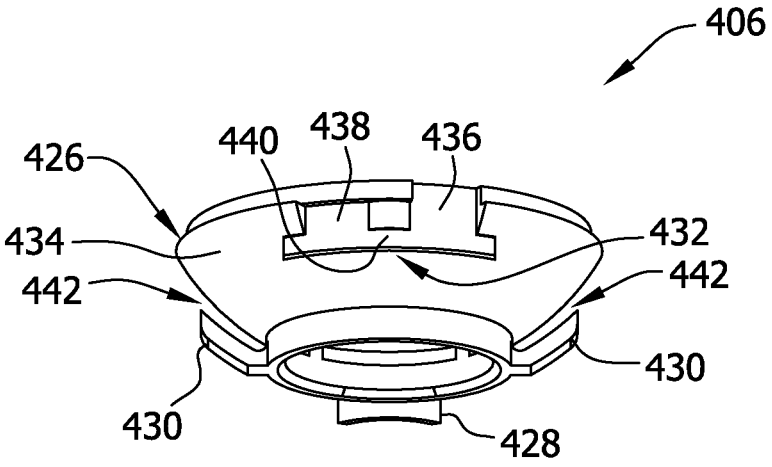
FIG. 10 is a perspective view of a cutter holder of the cutter frame assembly of FIG. 8.

In the illustrated embodiment of FIG. 8, the three cutter holders 406 are substantially similar, and each cutter holder 406 comprises (with reference to FIG. 10) a bowl 426, a substantially L-shaped pivot arm 428 extending outwardly from the bowl 426, and a pair of prongs 430 extending obliquely upward from the bowl 426. The bowl 426 comprises a pair of tracks 432 formed on opposite sides of an outer surface 434 thereof, wherein each track 432 comprises an inlet section 436, a cove section 438, and a runner section 440 linking the inlet section 436 to the cove section 438. Additionally, each prong 430 is spaced apart from the outer surface 434 of the bowl 426 to form a gap 442 between the prong 430 and the outer surface 434, with the gap 442 being sized to receive the sloped inner wall 416 of the holder support 408.

Figure 11:
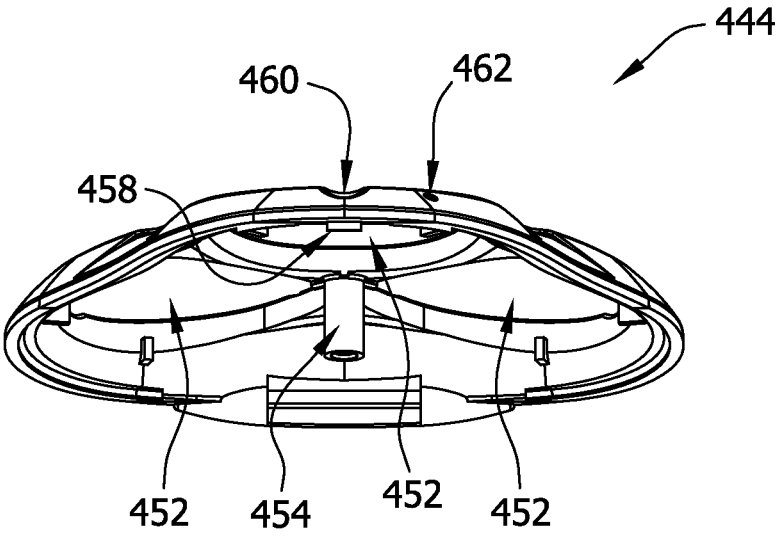
FIG. 11 is a perspective view of an upper cutter frame of the cutter frame assembly of FIG. 8.

Referring back to FIG. 8, the illustrated cutter frame assembly 400 also comprises an upper cutter frame 444, a plurality of cutters 446, a plurality of cutter cases 448, and a fastener 450. FIG. 11 is an enlarged perspective view of the upper cutter frame 444. The illustrated upper cutter frame 444 comprises three cutter ports 452 arranged in a generally triangular configuration, wherein each of the ports 452 is sized to receive one of the cutter cases 448. Optionally, the upper cutter frame 444 may comprise a threaded central boss 454, a hinge 456 (FIG. 8), and a locking tab 458 to facilitate connecting the upper cutter frame 444 to the lower cutter frame 402 and/or to the handle assembly 102. Suitably, the upper cutter frame 444 further comprises at least one locking indicator element (e.g., a structural element such as a dimple 460 and/or indicia) and at least one unlocking indicator element (e.g., a protrusion 462) that correspond to each port 452 to facilitate indicating to a user the locked and unlocked positions of the cutter case 448 that corresponds to each port 452.

Figure 12:
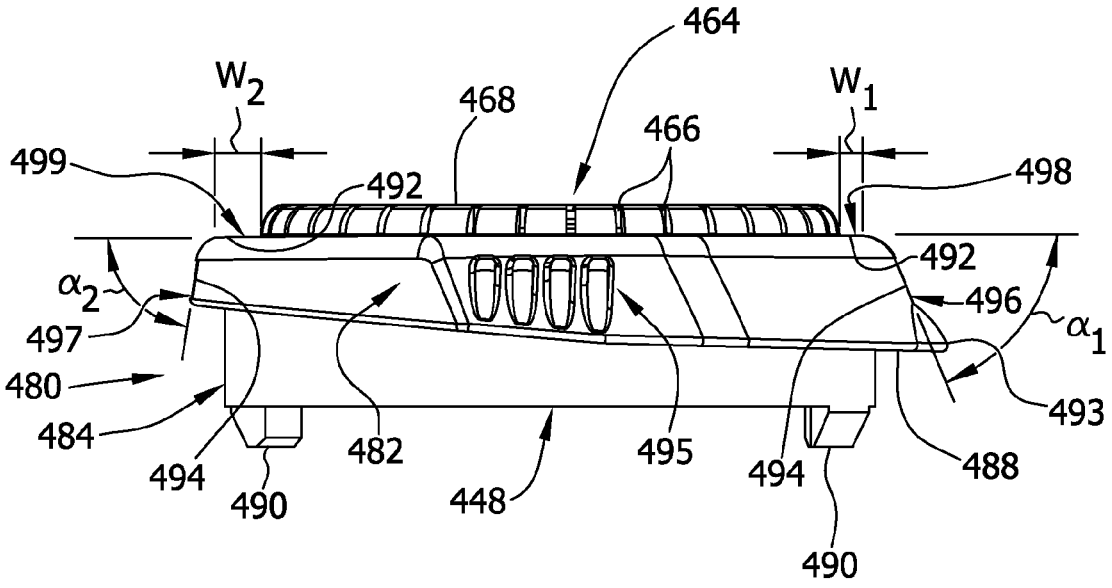
FIG. 12 is a side elevation view of a cutter case of the cutter frame assembly of FIG. 8.

Each of the illustrated cutters 446 comprises a cup-shaped outer cutter 464 (FIG. 12) having a plurality of slits 466 disposed in a skin contacting surface 468 thereof to facilitate receiving hair to be cut. The illustrated cutter 446 also comprises a buffer ring 470, an inner cutter 472, and an inner cutter stem 474, wherein each is sized for disposition within the outer cutter 464. Suitably, the inner cutter stem 474 may be formed with or connected to a bottom surface 476 of the inner cutter 472 and/or the inner cutter stem 474 may define a socket 478 (e.g., a cross-shaped socket) sized to mate with the tip 366 of the pin 352 from the torque transfer assembly 306 to facilitate drivingly connecting the torque transfer assembly 306 to the cutters 446 such that each inner cutter 472 is operatively connected to a respective one of the drive shafts 210 for conjoint rotation therewith.

Each cutter case 448 comprises an annular body 480 having a top section 482 and a generally cylindrical bottom section 484. The top section 482 forms an inner flange 486 (illustrated in FIG. 8) and an outer flange 488 that project transversely inward and outward, respectively, from the bottom section 484. Suitably, two locking members 490 extend downward from transversely opposite sides of the bottom section 484 to facilitate sliding along the tracks 432 of the corresponding holder 406, as described below.

The illustrated top section 482 of the cutter body 480 comprises an annular upper skin contacting surface 492 and a peripheral skin contacting surface 494 circumscribing and depending from the upper skin contacting surface 492. Specifically, the peripheral skin contacting surface 494 is angled generally transversely outward relative to the upper skin contacting surface 492. In the illustrated embodiment, the slope of the peripheral skin contacting surface 494 varies (i.e., is non-uniform) about the case 448, such that a first annular segment 496 of the peripheral skin contacting surface 494 is oriented at a first angle $\alpha_1$ relative to the upper skin contacting surface 492 and second, and in the illustrated embodiment opposite, annular segment 497 of the peripheral skin contacting surface 494 is oriented at a second angle $\alpha_2$ relative to upper skin contacting surface 492, wherein the second angle $\alpha_2$ is greater than the first angle $\alpha_1$. Additionally, a width of the upper skin contacting surface 492 varies (i.e., is non-uniform) about the case 448, such that a first annular segment 498 of the upper skin contacting surface 492, which is adjacent the first annular segment 496 of the peripheral skin contacting surface 494, has a first width $W_1$ and such that a second annular segment 499 of the upper skin contacting surface 492, which is adjacent the second annular segment 497 of the peripheral skin contacting surface 494, has a second width $W_2$ that is greater than the first width $W_1$.

Suitably, the upper skin contacting surface 492 and/or the peripheral skin contacting surface 494 comprises one or more alignment elements (e.g., an alignment finger 493 in the illustrated embodiment) that facilitates indicating to a user an alignment of the case 448 relative to the locking indicator element (e.g., the dimple 460) and/or unlocking indicator element (i.e., the protrusion 462) of the upper cutter frame 444. Additionally, the upper skin contacting surface 492 and/or the peripheral skin contacting surface 494 may include ridges 495 that facilitate enabling a user to grip the case 448.

In one embodiment of a method of making a rotary shaver such as the rotary shaver 100, the head assembly mount 200 is inserted into the second end 108 of the handle assembly 102 and is mounted on the handle assembly 102 via suitable fasteners to form the upper receptacle 112. When the head assembly mount 200 is fastened to the handle assembly 102, the drive shafts 210 (i.e., the tips 212, the retaining rings 214, and the roughened surfaces 216) protrude through the head assembly mount 200 and into the upper receptacle 112 in a substantially triangular configuration, and the spring seat 202 projects into the upper receptacle 112 centrally between the drive shafts 210.

To assemble the hair retention assembly 300, the tray 302 is inserted into the boot 304 such that the boot 304 stretches to conform to the contours of the sidewall 312 of the tray 302 (i.e., such that the gripping portion 340 of the boot 304 firmly grips the sidewall 312, and the skirt portion 342 of the boot 304 loosely hangs from the gripping portion 340), and the tabs 344 of the boot 304 are inserted into the tab slots 326 of the tray 302 to support the boot 304 about the tray 302.

With the boot 304 in gripping engagement with the tray 302, the seals 332 are fastened to the bottom surface 330 of the base 310 of the tray 302 about the shaft apertures 316 such that the holes 334 of the seals 332 are substantially coaxially aligned with the shaft apertures 316. The spring 372 of the pivot assembly 308 is then seated on the head assembly mount 200 about the spring seat 202, and the tray 302 is inserted into the upper receptacle 112 such that the spring 372 is substantially coaxially aligned with the central bore 318 of the tray 302 and such that the drive shafts 210 extend through the holes 334 of the seals 332, through the shaft apertures 316, and into the hair pocket 314. Specifically, the tip 212, the retaining ring 214, and the roughened surface 216 of each drive shaft 210 are situated within the hair pocket 314 of the tray 302.

With the tray 302 positioned within the upper receptacle 112, the spring 372 biases the tray 302 away from the head assembly mount 200 to space the feet 328 of the tray 302 a distance apart from the head assembly mount 200. The screw 376 is then inserted through the washer 378, through the central bore 318, through the spring 372, and into the threaded bore 208 of the spring seat 202 to secure the tray 302 to the head assembly mount 200 such that the washer 378 substantially covers the central bore 318. The screw 376 is then tightened such that a space is left between the feet 328 of the base 310 and the head assembly mount 200 to facilitate permitting the tray 302 to pivot about the spring seat 202 (i.e., about a longitudinal axis Y (shown in FIG. 2) extending through the handle assembly 102) within the receptacle 112.

With the tray 302 secured to the head assembly mount 200, the torque transfer assemblies 306 are connected to the drive shafts 210. Specifically, the caps 348 are connected to the tips 212 of the respective drive shafts 210 such that the bottom walls 354 of the caps 348 are seated on the retaining rings 214 and such that the inner surfaces 362 of the ports 358 frictionally engage the roughened surfaces 216. After the caps 348 are connected to the drive shafts 210, the pins 352 are seated on the biasing members 350 within the caps 348 such that the hollow bodies 368 of the pins 352 receive the biasing members 350 and such that the guides 370 of the pins 352 are inserted into the channels 360 of the caps 348.

To assemble the cutter frame assembly 400, the biasing element 404 is seated on the lower cutter frame 402 about the spring seat 422 of the base 410. The cutter holders 406 are then connected to the lower cutter frame 402 such that the pivot arms 428 of the cutter holders 406 are inserted into the biasing element 404 and such that the sloped inner walls 416 of each holder support 408 are received within the gaps 442 of the respective cutter holder 406 (i.e., the prongs 430 are positioned below the lower surfaces 420 of the sloped inner walls 416, and the bowl 426 is positioned atop the upper surfaces 418 of the sloped inner walls 416). With the cutter holders 406 mounted on the lower cutter frame 402, the fastener 450 is inserted through the bore 424 of the base 410, through the biasing element 404, and into the central boss 454 of the upper cutter frame 444 to fasten the lower cutter frame 402 to the upper cutter frame 444.

The inner cutters 472 and the inner cutter stems 474 are then inserted into the cutter holders 406 (i.e., each inner cutter 472 is inserted into the respective cutter holder 406 with the inner cutter stem 474 suitably connected to the bottom surface 476 thereof). With the inner cutters 472 and inner cutter stems 474 inserted into the cutter holders 406, the outer cutters 464 are inserted into the cutter cases 448 and are seated against the inner flanges 486, and the buffer rings 470 are inserted into the cutter cases 448 against the outer cutters 464. Specifically, the outer cutters 464 are inserted into the cutter cases 448 such that the skin contacting surfaces 468 of the outer cutters 464 are exposed though the cutter cases 448 and are substantially parallel to the respective upper skin contacting surfaces 492 of the cutter cases 448.

With the outer cutters 464 positioned within the cutter cases 448, the cutter cases 448 are then fastened to the cutter holders 406 through the cutter ports 452 and about the inner cutters 472. Specifically, the alignment fingers 493 of the cutter cases 448 are aligned with the protrusions 462 of the upper cutter frame 444, and the locking members 490 of the cutter cases 448 are inserted into the tracks 432 of the cutter holders 406 via the inlet sections 436 of the tracks 432. The cutter cases 448 are then rotated such that the locking members 490 slide across the respective runner sections 440 of the tracks 432 and are secured within the cove sections 438 of the tracks 432. When the cutter cases 448 are secured to the cutter holders 406, the alignment finger 493 is aligned with the dimple 460 of the upper cutter frame 444.

After the hair retention assembly 300 is mounted on the handle assembly 102 and the cutter frame assembly 400 is assembled, the cutter frame assembly 400 is hingedly connected to the hair retention assembly 300 at the hinge 456, and the locking tab 458 of the upper cutter frame 444 engages the lock 337 of the tray 302. Moreover, when the cutter frame assembly 400 is mounted on the hair retention assembly 300, the pins 352 of the torque transfer assembly 306 are inserted through the bowls 426 of the cutter holders 406 to engage the inner cutter stems 474 (i.e., the tips 366 of the pins 352 engage the sockets 478 of the inner cutter stems 474) to facilitate operatively connecting each of the inner cutters 472 to a respective one of the drive shafts 210 for conjoint rotation therewith (i.e., to facilitate transferring torque from the drive shafts 210 to the inner cutters 472 when the rotary shaver 100 is operating).

During an exemplary operation of the rotary shaver 100, a user grasps the handle assembly 102 and glides the outer cutters 464 over the skin such that hairs from the skin are directed into the slits 466 of the outer cutters 464, wherein the hairs are cut via the rotating inner cutters 472 and are stored in the hair pocket 314 of the hair retention assembly 300 for subsequent disposal. As the outer cutters 464 glide over contours of the skin (e.g., the contours of the user's face), the outer cutters 464 and the cutter cases 448 are permitted to float up and down via the biasing element 404 to facilitate maintaining the outer cutters 464 in contact with the skin. Specifically, when rounding a contour, the pivot arms 428 of the cutter holders are permitted to compress the biasing element 404 such that the cutter holders 406 slide along the respective arms (i.e., the prongs 430 slide underneath the lower surfaces of the sloped inner walls 416, and the bowl 426 slides atop the upper surfaces 418 of the sloped inner walls 416). Optionally, in an alternative embodiment, the outer cutters may be permitted to float within, and relative to, the cutter cases 448.

To further facilitate maintaining the skin contacting surfaces 468 of the outer cutters 464 in contact with the skin when rounding contours of the skin, the head assembly 104 is permitted to float up and down within the upper receptacle 112 and/or to pivot relative to the handle housing 110 within the upper receptacle 112 in any direction about the entire circumference of the shaver head assembly 104 (i.e., pivot in 360 degrees about the longitudinal axis Y) via the spring 372 due in part to the space left between the feet 328 of the tray 302 and the head assembly mount 200. Moreover, the spring 372 biases the head assembly 104 generally longitudinally away from the handle housing 110 such that the head assembly 104 is moveable longitudinally toward the handle housing 110 against the bias of the spring in response to pressure applied to the head assembly 104 by a user of the shaver 100.

Additionally, because the spring 372 of the pivot assembly 308 is positioned in the upper receptacle 112 (i.e., exterior of the hair pocket 314) in the illustrated embodiment, rather than in the hair pocket 314, an accumulation of hair within the hair pocket 314 does not limit the pivot range of the head assembly 104. Additionally, when either the head assembly 104 and/or the cutter cases 448 float and/or pivot, the caps 348 of the torque transfer assemblies 306 maintain a fixed position relative to the drive shafts 210 because the caps 348 are seated atop the retaining rings 214. The pins 352 are also permitted to float and pivot within the caps 348 via compression of the biasing members 350, which facilitates maintaining a driving engagement between the pins 352 and the inner cutter stems 474 despite the floating and/or pivoting.

Because the first annular segments 496 of the peripheral skin contacting surfaces 494 are sloped at a lesser angle than the second annular segments 497 of the peripheral skin contacting surfaces 494, the transition of the skin from the upper cutter frame 444 to the upper skin contacting surfaces 492 of the cutter cases 448 is gradual to facilitate enabling the skin to slide smoothly from the upper cutter frame 444 up to, and subsequently down from, the upper skin contacting surfaces 492. Moreover, because the width $W_1$ of the first annular segments 498 of the upper skin contacting surfaces 492 is greater than the width $W_2$ of the second annular segments 499 of the upper skin contacting surfaces 492 and because the cutter cases 448 are arranged on the upper cutter frame 444 such that the second annular segments 499 of the upper skin contacting surfaces 492 face one another (i.e., are oriented toward the center of the head assembly 104), the combined surface area of the upper skin contacting surfaces 492 of the cutter cases 448 is greater proximate a central region of the upper cutter frame 444 to facilitate enabling a smoother transition of the skin across the head assembly 104 from any given cutter case 448 to the adjacent cutter cases 448.

Additionally, after a shaving operation, the user may empty the hair stored in the hair pocket 314 by unlatching the locking tab 458 from the lock 337 via the lock release button 114 and swinging the cutter frame assembly 400 away from the hair retention assembly 300 via the hinge 456. However, if the user desires to clean the cutters 446 without accessing the hair pocket 314, the user may grasp the cutter cases 448 (i.e., via the ridges 495), apply a downward force to the cutter cases 448, and rotate the cutter cases 448 relative to the cutter holders 406 such that the locking members 490 slide downward within the cove sections 438, back across the runner sections 440, and upward through the inlet sections 436, thereby releasing the cutter cases 448 from the cutter holders 406 to access the cutters 446 (i.e., each of the cutter cases 448 is individually releasable from the head assembly 104). When one of the cutter cases 448 is removed from the respective cutter holder 406, the outer cutter 446, the inner cutter 472, and/or the inner cutter stem 474 are removeable from within the cutter case 448 to facilitate cleaning the cutters 446. In one embodiment, when resecuring the cutter cases 448 to the cutter holders 406, the user may align the alignment finger 493 of the cutter case 448 with the protrusion 462 of the upper cutter frame 444 to insert the locking members 490 into the inlet sections 436 and may subsequently rotate the cutter case 448 toward the dimple 460 to engage the locking members 490 within the cove sections 438, thereby securing the cutter case 448 to the cutter holder 406.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary electric shaver comprising:

a handle assembly including a housing, a motor disposed in the housing, and a plurality of drive shafts operatively connected to the motor and extending at least in part exterior of the housing; and a head assembly having a circumference and defining a hair pocket, the head assembly comprising:

a plurality of inner cutters each operatively connected to a respective one of the drive shafts for conjoint rotation therewith;

a plurality of outer cutters each paired with a respective one of the inner cutters;

a tray defining a bottom of the hair pocket, the hair pocket being shared by the cutters such that hair cut by a first one of the pairs of inner and outer cutters is permitted to commingle on the tray with hair cut by a second one of the pairs of inner and outer cutters; and an elongate fastener connecting the head assembly to the handle assembly such that the fastener extends from the handle assembly at least in part within the tray, wherein the head assembly is connected to the handle assembly such that the hair pocket, and hence the tray, pivots relative to the fastener and the handle assembly about the entire circumference of the head assembly as the outer cutters glide over skin contours during a shaving operation.

2. The rotary electric shaver of claim 1 further comprising a resilient biasing element biasing the head assembly away from the handle assembly, wherein the head assembly floats toward the handle assembly against the bias of the biasing element in response to pressure applied to the head assembly by a user of the shaver.

3. The rotary electric shaver of claim 2 wherein the biasing element circumscribes the fastener and is disposed exterior of the hair pocket.

4. The rotary electric shaver of claim 1 wherein a single elongate fastener connects the head assembly to the handle assembly.

5. A rotary electric shaver comprising:

a handle assembly housing a motor; and a head assembly connected to the handle assembly, wherein the head assembly has a circumference and defines a hair pocket, the head assembly comprising:

a cutter frame assembly covering the hair pocket, the cutter frame assembly including a plurality of inner cutters and a plurality of outer cutters, wherein each of the outer cutters is paired with a respective one of the inner cutters;

a tray defining a bottom of the hair pocket, wherein the hair pocket is shared by the cutters such that hair cut by a first one of the pairs of inner and outer cutters is permitted to commingle on the tray with hair cut by a second one of the pairs of inner and outer cutters;

a resilient, generally cylindrical biasing element disposed generally centrally beneath and exterior of the hair pocket; and a fastener connecting the head assembly to the handle assembly, the biasing element circumscribing the fastener such that the fastener extends through the biasing element to engage the handle assembly, wherein the hair pocket, and hence the tray, pivots relative to the handle assembly about the entire circumference of the head assembly as the outer cutters glide over skin contours during a shaving operation, and wherein the biasing element biases the head assembly from a pivoted position into a non-pivoted position.

6. The rotary electric shaver of claim 5 wherein the tray has a plurality of shaft apertures arranged in a generally triangular configuration.

7. The rotary electric shaver of claim 5 wherein the cutter frame assembly comprises:

a single-piece upper cutter frame defining three cutter ports arranged in a generally triangular configuration; and a lower cutter frame fastened to the upper cutter frame to maintain each of the inner cutters in paired relation with one of the outer cutters such that each of the pairs of inner and outer cutters is disposed within one of the cutter ports, wherein the cutter frame assembly is configured for displacement from covering the hair pocket such that the upper cutter frame, the lower cutter frame, the inner cutters, and the outer cutters move as one conjoint unit when the cutter frame assembly is displaced.

8. The rotary electric shaver of claim 7 wherein the cutter frame assembly further comprises a plurality of cutter cases, each cutter case configured to circumscribe one of the pairs of inner and outer cutters.

9. The rotary electric shaver of claim 8 wherein the cutter frame assembly is configured to permit the cutter cases to pivot relative to one another.

10. The rotary electric shaver of claim 5 wherein each of the outer cutters is a cup shaped outer cutter and each of the inner cutters is disposed within a respective one of the cup shaped outer cutters, the head assembly further comprising a torque transfer assembly associated with each of the inner cutters for maintaining a pivoting drive connection between the inner cutters and the motor, wherein each torque transfer assembly has an inner cutter biasing member that is seated above the tray and in the hair pocket when the cutter frame assembly is covering the hair pocket.

11. The rotary electric shaver of claim 10 wherein the cutter frame assembly comprises an upper cutter frame and a lower cutter frame connected to the upper cutter frame to retain the inner cutters within the outer cutters such that the torque transfer assemblies extend through the lower cutter frame for driving connection with the inner cutters when the cutter frame assembly is covering the hair pocket.

12. A rotary electric shaver comprising:

a handle assembly housing a motor; and a head assembly connected to the handle assembly, wherein the head assembly has a circumference and defines a hair pocket, the head assembly comprising:

a cutter frame assembly covering the hair pocket, the cutter frame assembly including a plurality of inner cutters and a plurality of outer cutters, wherein each of the outer cutters is paired with a respective one of the inner cutters;

a tray defining a bottom of the hair pocket, wherein the hair pocket is shared by the cutters such that hair cut by a first one of the pairs of inner and outer cutters is permitted to commingle on the tray with hair cut by a second one of the pairs of inner and outer cutters;

a resilient biasing element disposed beneath and exterior of the hair pocket; and an elongate fastener connecting the head assembly to the handle assembly such that the fastener extends from the handle assembly at least in part within the tray, the fastener being secured to the handle assembly such that the fastener does not pivot relative to the handle assembly, wherein the hair pocket, and hence the tray, pivots relative to the handle assembly about the entire circumference of the head assembly as the outer cutters glide over skin contours during a shaving operation, and wherein the biasing element biases the head assembly from a pivoted position into a non-pivoted position.

13. The rotary electric shaver of claim 12 wherein a single elongate fastener connects the head assembly to the handle assembly.

14. A rotary electric shaver comprising:

a handle assembly housing a motor; and a head assembly connected to the handle assembly, wherein the head assembly has a circumference and defines a hair pocket, the head assembly comprising:

a cutter frame assembly covering the hair pocket, the cutter frame assembly including a plurality of inner cutters and a plurality of outer cutters, wherein each of the outer cutters is paired with a respective one of the inner cutters;

a tray defining a bottom of the hair pocket, wherein the hair pocket is shared by the cutters such that hair cut by a first one of the pairs of inner and outer cutters is permitted to commingle on the tray with hair cut by a second one of the pairs of inner and outer cutters;

a resilient biasing element disposed beneath and exterior of the hair pocket; and an elongate fastener connecting the head assembly to the handle assembly such that the fastener extends from the handle assembly at least in part within the tray, wherein the hair pocket, and hence the tray, pivots relative to the fastener and the handle assembly about the entire circumference of the head assembly as the outer cutters glide over skin contours during a shaving operation, and wherein the biasing element biases the head assembly from a pivoted position into a non-pivoted position.

15. The rotary electric shaver of claim 14, wherein the biasing element circumscribes the fastener such that the fastener extends through the biasing element to engage the handle assembly.

16. The rotary electric shaver of claim 15, wherein the head assembly is not connected to the handle assembly other than by the fastener extending through the biasing element.

17. The rotary electric shaver of claim 16 wherein the cutter frame assembly comprises:

a single-piece upper cutter frame defining three cutter ports arranged in a generally triangular configuration; and a lower cutter frame fastened to the upper cutter frame to maintain each of the inner cutters in paired relation with one of the outer cutters such that each of the pairs of inner and outer cutters is disposed within one of the cutter ports, wherein the cutter frame assembly is configured for displacement from covering the hair pocket such that the upper cutter frame, the lower cutter frame, the inner cutters, and the outer cutters move as one conjoint unit when the cutter frame assembly is displaced.

18. The rotary electric shaver of claim 13 wherein a single elongate fastener connects the head assembly to the handle assembly.

* * * * *